United States Patent [19]

Drexler

[11] 4,144,662

[45] Mar. 20, 1979

[54] DISPLAY AND DISPENSER

[76] Inventor: Halbert H. Drexler, 7 Bagatelle Rd., Dix Hills, N.Y. 11746

[21] Appl. No.: 812,792

[22] Filed: Jul. 5, 1977

[51] Int. Cl.[2] ..... G09F 3/18

[52] U.S. Cl. ..... 40/10 D; 211/49 D

[58] Field of Search ..... 140/68 R, 10, 10 D, 140/19, 124; 211/49 D

[56] References Cited

U.S. PATENT DOCUMENTS

| | | | |
|---|---|---|---|
| 2,599,111 | 6/1952 | Kicher | 40/19 |
| 2,621,429 | 12/1952 | Teich | 40/152.1 |
| 3,287,073 | 11/1966 | Holtkamp | 211/49 D |
| 3,449,848 | 6/1969 | Howell | 40/10 R X |
| 4,001,059 | 1/1977 | Grendahl | 40/152.1 |
| 4,019,269 | 4/1977 | Vix | 40/19 |

*Primary Examiner*—Russell R. Kinsey
*Assistant Examiner*—Wenceslao J. Contreras
*Attorney, Agent, or Firm*—Marvin Feldman; Stephen E. Feldman

[57] ABSTRACT

A cylindrical casing having a removable top cover and outer wall of clear plastic is radially divided throughout its height to provide hollow columns within which containers, such as those used to dispense pills or food supplements, may be stacked one atop the other. An opening is provided at the lower extremity of each column to permit removal of a single container; while each column is formed to receive, just behind and inside said outer wall, a changeable information carrier upon which advertising or other information about the substance stored within the containers stacked in that particular column. The entire cylindrical casing is carried by a stand for 360 degrees rotation to present to the user, in turn, each column of containers and the information concerning same.

9 Claims, 4 Drawing Figures

DISPLAY AND DISPENSER

BACKGROUND OF THE INVENTION—FIELD OF APPLICATION

This invention relates to display and dispensing devices; and more particularly to devices for displaying, for purposes of dispensing, containers.

BACKGROUND OF THE INVENTION—DESCRIPTION OF THE PRIOR ART

The myriad of items on sale to the consumer in drug and variety stores is, at times, mind boggling. Especially since most of such items are in relatively small packages which might be bottles, boxes, or the like. Such packages may contain pills, vitamins, food supplements or other health or beauty aids and may be of plastic, glass cardboard or other convenient substance. No matter what, they are usually closely stacked on shelves and on top of counters; making location of the desired item at times difficult, and at other times impossible.

Quite often the manufacturer would like to provide an information display along with the item to be sold. If the item is in plastic or paper packets it is often stapled to a display card. But, as packets are sold off the display card starts to present an unpleasant and empty look, and usually takes up more room then its worth. It, however, cannot be discarded before the last item is sold unless the merchant is willing to discard what otherwise might be saleable product.

Other item displays are currently available but generally they try to mount a maximum of product in a minimum of space. Most of the time the showing of information about the product is to the side of, or above, the product. This type of display becomes cumbersome and interferes with the ability of the sales clerk to view the store, and to complete the transaction. Most merchants try to avoid such displays and that limits the manufacturer in competing for product sales with other products.

SUMMARY OF THE INVENTION

It is therefore an object of this invention to provide a new and improved container dispenser.

It is another object of this invention to provide a new and improved container display and dispensing device.

It is still another object of this invention to provide a new and improved dispensing and display device for relatively small containers.

It is yet still another object of this invention to provide a novel and improved device for displaying and dispensing containers and which displays proximate such containers information concerning the contents of the container.

It is a further object of this invention to provide a novel and improved device for displaying and dispensing a number of groups of containers each group containing a different substance.

It is still a further object of this invention to provide a novel and improved device for displaying and dispensing a number of different substances each contained in a number of different containers; and to display proximate such containers product information peculiar to each type of substance.

It is yet still a further object of this invention to provide a novel and improved device for displaying and dispensing containers in groups each group with a different substance and for displaying proximate each such group information about the substance, but in such a manner that the device can easily be changed to accommodate containers with different substances and different information.

This invention involves a cylindrical display, which is mounted to rotate 360 degrees and, which is formed with a clear outer wall and radially extending vertical walls to subdivide the device into vertical columns. Openings are provided in the outer wall at the base of each column and sized to permit removal of a single container from a stack of containers stored in the column. The column configuration and clear outer wall removably accommodate a carrier containing information about whatever is in the containers.

Other objects, features, and advantages of the invention in its details of construction and arrangement of parts will be seen from the above, from the following description of the preferred embodiment when considered in conjunction with the drawings and from the appended claims.

DESCRIPTION OF THE PREFERRED EMBODIMENT

For convenience the invention will be described as applied to a display and dispenser having a generally cylindrical outer wall formed from clear plastic and which is radially subdivided by plastic walls to form vertical columns each to accommodate a stack of short and round containers for vitamins. A cardboard strip is sized to fit behind and just inside the clear wall of each column and contain information about the vitamins in the containers stacked in that column. The entire device is mounted on a base in order to facilitate its rotation through 360 degrees. It should be understood, nevertheless, that without departing from the scope of the invention: that the device may be other than cylindrical and that it may be of glass of other substance that can be easily seen through; that the walls may be of any convenient material; that the vertical columns may store containers made from glass, paper or any convenient substance; and that the information carrier may be formed from paper plastic or other material, and may display any desired information whether it be about the product in the containers behind the carrier or just information in general.

Figure 1:
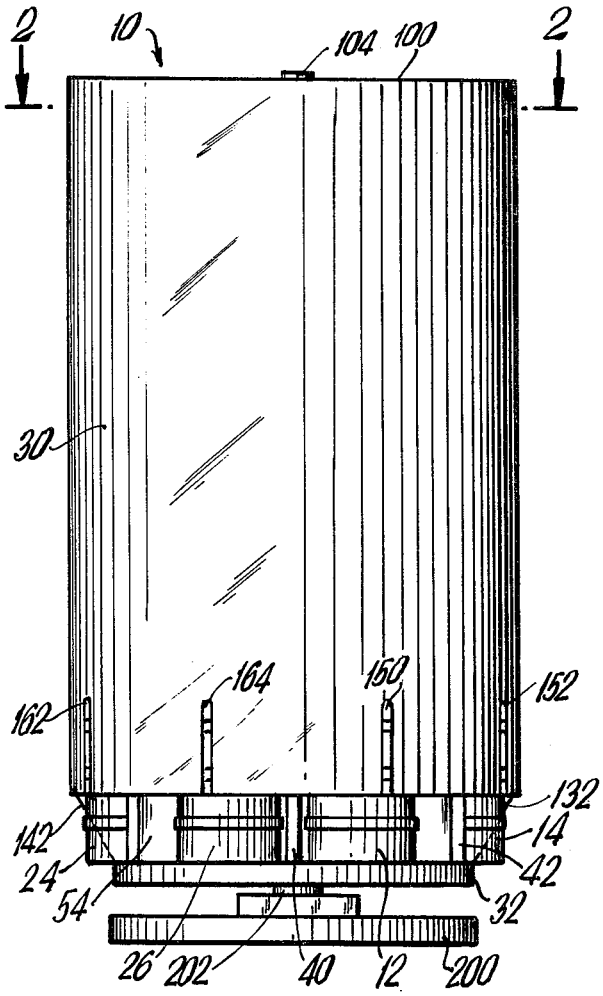
FIG. 1 is an elevational view of a display and dispenser embodying the instant invention.
Figure 2:
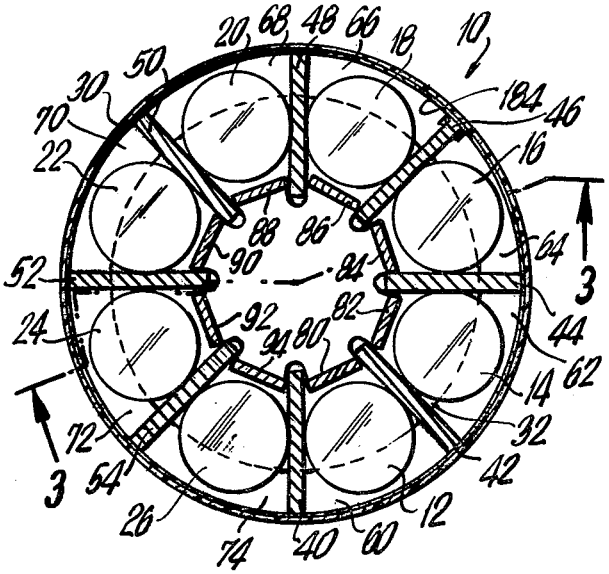
FIG. 2 is a sectional view taken along line 2—2 of the display and dispenser of FIG. 1.
Figure 4:
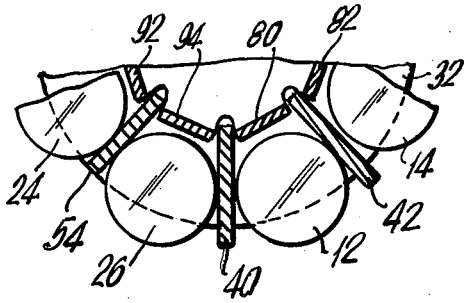
FIG. 4 is a partial sectional view taken along line 4—4 of FIG. 3.

With reference to FIGS. 1 and 2, there is shown at 10 a device for displaying and dispensing containers 12,14,16,18,20,22,24 and 26 within which vitamins or the like are stored for sale to the ultimate consumer.

Device 10 is formed with a generally cylindrical outer wall 30 of clear plastic that is secured to a base member 32 of disc-like configuration. Base 32 may be of the same plastic as outer wall 30, or it may be of other convenient material. A plurality of radially and vertically extending walls 40,42,44,46,48,50,52 and 54 divide the inside of device 10 into a plurality of vertical columns 60,62,64,66,68,70,72 and 74 within which containers 12–26 respectively are stacked. Vertical walls may be secured in place by being lodged in grooves formed in base 32, by being secured to base 32 by adhesive or the like and/or by being secured to the inner surface of outer wall 30 as by an adhesive or other suitable means. A number of inner walls 80,82,84,86,88,90,92 and 94 are provided for vertical columns 60–74 respectively.

A top 100 sized to close an upper opening 102 for device 10 and formed of plastic or other suitable material, is removably secured in place by a threaded member 104 which is threaded into the top of a center disc 106 appropriately supported and secured to base 32.

It should be noted that the outer circumference of base 32 is smaller than that of outer wall 30, and that the lower extremity of outer wall 30 proximate each vertical column 60–74 is cut away as at 132 and 142 (FIGS. 1 and 3) to provide openings through which only a single container (12–26) may be withdrawn. A plurality of vertical slits 150,152,162,164 (FIG. 1) are formed to extend upwardly from the lower extremity of carrier 184 proximate each such opening to facilitate determination of how many containers (12–26) may be in each column 60–74.

Figure 3:
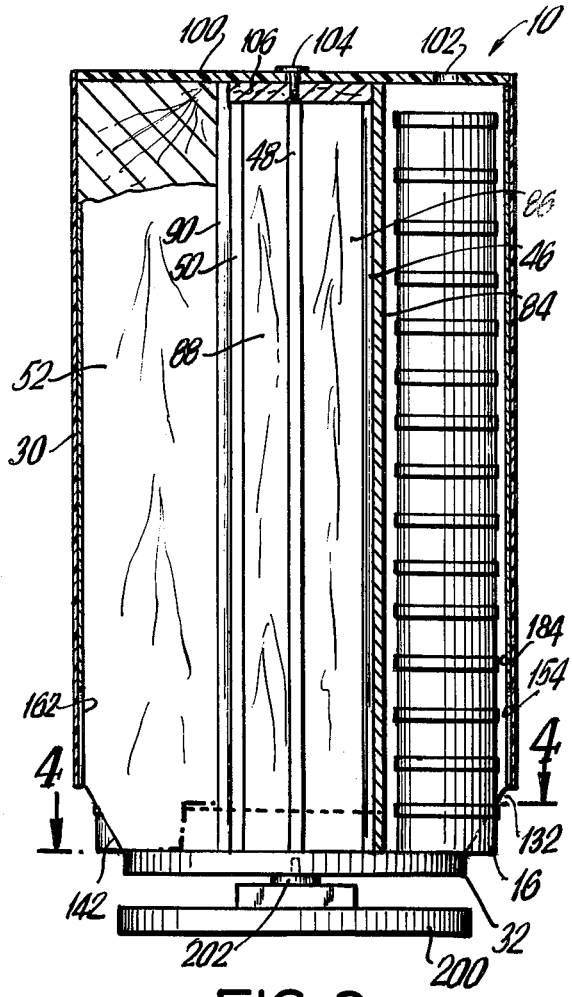
FIG. 3 is a vertical sectional view taken along line 3—3 in FIG. 2.

An information carrier 184 as shown in FIG. 3, is provided sized to fit behind outer wall 30 and between the vertical walls 40–54 that make up each column 60–74. Carrier 184 is formed from cardstock or paper and each may carry information peculiar to the product within the containers stacked in the column behind the carrier; or if desired, any other information.

A support 200, (FIGS. 1 and 3) is provided for device 10, and is fitted with a bushing or bearing 202 co-operating with suitable rotative means secured to the underside of base 32 to facilitate 360 degree rotation for device 10.

In using device 10 either the manufacturer, supplier, or retail merchant may fill columns 60–74 by unscrewing threaded member 104 and lifting off top 100. Each column 60–74 is then filled with a stack of containers 12-26. An information carrier 180–194 is then placed behind the inner surface of outer wall 30 and between vertical walls 40–54. The substance of carrier 180–194 and its curved condition behind outer wall 30 should retain same in place. If desired vertical walls 40–54 may be notched to provide seats for carrier 184. The carrier will generally contain information concerning the product in the containers stacked in its particular column; and is slit at its bottom as shown at 150–164.

To dispense a container 12–26 the merchant need only remove the bottom container from the stack. The rest of the container in the stack will then just drop down.

By looking through wall 30 and slits 150–164, the merchant can determine when the containers in each stack are getting low. Refilling is accomplished by removing top 100 and adding more containers.

Obviously device 10 can accommodate containers with different substances by merely removing all containers (if any remain) within a particular column and stacking new containers therein. If an appropriate information carrier is not available the merchant may either prepare and insert one of his own design, or he may merely leave that column without an information carrier.

From the above description it should be seen that a new and improved display and dispensing device has been provided; which device is compact and lightweight, can store a number of columns of containers with easy access and removal of the bottom container in each stack, and with information concerning the contents of the containers in each such stack viewable in positions proximate the stack to which the information pertains.

It is understood that although I have shown the preferred form of my invention that various modifications may be made in details thereof without departing from the spirit as comprehended from the following claims:

I claim:

1. A display and dispensing device; comprising:

(a) casing means having a transparent outer wall that forms a hollow enclosure open at its top and its bottom;

(b) base means secured proximate the bottom of said casing means;

(c) generally radially extending vertical wall means disposed within said casing means and dividing same into a plurality of vertical and hollow columns, wherein each vertical hollow column is sized to store a stack containing a plurality of containers of predetermined size and configuration;

(d) opening means, of predetermined size and configuration, formed in said casing means proximate the bottom thereon, said container being smaller than said opening to permit removal of one container from said stack; and (e) an information carrier means sized to fit between the vertical wall and proximate said outer wall so as to be viewed through same.

2. The device of claim 1, wherein said outer wall form a hollow enclosure that is cylindrical in configuration.

3. The device of claim 1, wherein said outer wall is formed of clear plastic.

4. The device of claim 1, including support means mounting said casing means for 360 degrees of rotation.

5. The device of claim 1, wherein said information carrier means contains information related to the containers which are to be stacked in the vertical hollow column proximate which the carrier is positioned.

6. The device of claim 5, wherein the information carrier is formed from card stock.

7. The device of claim 1, including a top sized to cover said top opening into said hollow enclosure and means for securing said top in position thereon.

8. The device of claim 1, wherein vertically disposed inner wall are provided to separate the inner extremities of said radially extending vertical walls.

9. The device of claim 1, wherein slits are formed extending upwardly from said opening means in said casing means.

* * * * *